US006752368B2

(12) United States Patent
Winchip et al.

(10) Patent No.: US 6,752,368 B2
(45) Date of Patent: Jun. 22, 2004

(54) CLAMPING DEVICE AND METHOD FOR GRASPING A WORKPIECE

(75) Inventors: Wade A. Winchip, Bettendorf, IA (US); Edward H. Connelly, Bettendorf, IA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/284,568

(22) Filed: Oct. 30, 2002

(65) Prior Publication Data

US 2004/0084594 A1 May 6, 2004

(51) Int. Cl.[7] ..... A47G 1/10

(52) U.S. Cl. ..... 248/316.2; 248/222.13; 248/317; 24/536; 211/113

(58) Field of Search ..... 248/316.2, 316.3, 248/317, 222.13; 24/536, 134 L, 134 R, 67.1; 211/45, 113

(56) References Cited

U.S. PATENT DOCUMENTS

| | | | | |
|---|---|---|---|---|
| 4,240,660 A | | 12/1980 | Roth et al. | 294/81 R |
| 4,555,159 A | * | 11/1985 | Chartrain et al. | 439/773 |
| 5,052,644 A | * | 10/1991 | Arieh et al. | 248/114 |
| 5,078,358 A | * | 1/1992 | Egly et al. | 248/447.1 |
| 5,478,041 A | | 12/1995 | Mayne | 248/514 |
| 5,619,789 A | | 4/1997 | Chung | 29/814 |
| 5,771,983 A | | 6/1998 | Rottmann | 174/84 |
| 5,897,087 A | | 4/1999 | Farley | 248/229.21 |
| 5,932,117 A | | 8/1999 | Johnson et al. | 219/121.63 |
| 5,964,440 A | | 10/1999 | An et al. | 248/316.2 |
| 6,125,514 A | | 10/2000 | Yu | 24/489 |
| 6,129,345 A | | 10/2000 | Chiorino | 269/32 |
| 6,237,970 B1 | | 5/2001 | Joannou | 292/241 |
| 6,276,947 B1 | | 8/2001 | Homfeldt et al. | 439/92 |

* cited by examiner

*Primary Examiner*—Korie Chan
(74) *Attorney, Agent, or Firm*—Matthew W. Smith; Norman F. Hainer, Jr.

(57) ABSTRACT

A clamping device for grasping and suspending a workpiece is disclosed. The clamping device comprises a clamp body, the clamp body comprises at least one slotted arcuate spring end portion; an intermediate spring spreading portion contiguous with and extending from the slotted arcuate spring end portion, the intermediate spring spreading portion having an eccentric bore; a jaw end portion contiguous with and extending from the intermediate spring spreading portion, the jaw end portion comprising a jaw clamping surface, and a bracket, the bracket having a beveled sidewall; wherein the jaw clamping surface and the bracket define a jaw opening; and a suspending means attached to the intermediate spring spreading portion; an eccentric wedge slideably mounted in the bracket; and an eccentric cam rotatably disposed within the eccentric bore.

12 Claims, 7 Drawing Sheets

CLAMPING DEVICE AND METHOD FOR GRASPING A WORKPIECE

FIELD OF THE INVENTION

The present invention relates to a clamping device for grasping a workpiece to secure the workpiece during subsequent steps of manufacture. The invention is particularly useful for grasping and hanging metal sheet of various thicknesses during thermal heat treatment processing steps.

BACKGROUND OF THE INVENTION

During the process of heat-treating metal sheet in a furnace, in order to ensure that the metal sheet is evenly heated and uniformly reaches the desired heat treatment temperature, it is advantageous to hang the metal sheet vertically from a rack. As many metal sheets as can fit into a furnace are fitted with one or more clamping devices, and suspended vertically from a rack. The rack, with the clamped metal sheets, is placed into a furnace for heating. Such heating is termed in the art as a vertical heat treat process.

Various clamping devices are known in the art. An apparatus for transporting sheets of glass in a vertical position is described in U.S. Pat. No. 4,240,660. The apparatus has suspension tongs, a carrying strap from which the tongs are suspended and a supporting beam mounted to a trolley.

A clamp device and a clamping system for welding sheet metal are taught in U.S. Pat. No. 6,129,345 and U.S. Pat. No. 5,932,117, respectively.

A latch fastener mechanism for thin sheet materials is described in U.S. Pat. No. 6,237,970 B1. More particularly, the invention relates to a simplified form of connector for ready installation that provides a disengageable clamping action between the parts being held together.

A clamp consisting of a clip and an actuating member is described in U.S. Pat. No. 5,052,644. The clamp of this invention is used for holding flat thin objects together.

U.S. Pat. No. 5,897,087 relates to a surgical apparatus for retracting anatomy to provide exposure of a surgical site. A cam tightened universal joint clamp is described.

A clamping and holding device, which is particularly useful for mounting umbrellas and the like to patio chairs, is taught in U.S. Pat. No. 5,478,041. A first and a second clamping arm are pivotally connected to one another to engage an article. A cam, cam follower and locking member or nut and bolt system prevents the inadvertent opening of the clamping arms.

The clamping device of the current invention finds particular utility in the field of metal or metal alloy heat treating. Metal heat treating typically involves the steps of heating the metal or metal alloy to a predetermined metal heat treatment temperature, holding or "soaking" the metal or metal alloy at a predetermined metal heat treatment temperature for a predetermined metal heat treatment length of time, and cooling the metal alloy. It is recognized by practitioners of the art that these steps can be repeated in various combinations which may include several predetermined metal heat treatment temperatures and several predetermined metal heat treatment lengths of time in order to obtain various desired properties, such as but not limited to, strength and corrosion resistance. It is further known in the prior art that metal heating and cooling rates can be varied to alter properties of the metal or metal alloy. It may be particularly useful to rapidly cool the metal or metal alloy after it has been exposed to a predetermined metal heat treatment temperature. A known method for rapid cooling the metal or metal alloy is to remove the metal or metal alloy workpiece from a metal heat treatment furnace, followed by immersing the workpiece in a water bath. This process is referred to by practitioners of the art as "water quenching."

Referring now to drawings in FIGS. 1–3, a known clamping device 10 used in the field of metal heat treating is presented. FIG. 1 is a front view drawing of the known clamping device 10, FIG. 2 is a side view of the same known clamping device 10 and FIG. 3 is a top view of the known clamping device 10. The known clamping device 10 is comprised of: (a) a hanging portion 11; (b) a clamp portion 12 extending from the hanging portion 11, with the clamp portion having a bracket 13 and a first clamping surface 14; and (c) a wedge 15 having a second clamping surface 16 that is parallel with respect to the first clamping surface 14, and is slideably mounted in the bracket 13 of the clamp portion 12. The hanging portion 11 allows for hanging the clamping device 10 vertically on a rack (not shown). The metal sheet 20 for heat treatment is positioned in the known clamping device 10 so that the upper edge 21 of the metal sheet 20 is between the first clamping surface 14 and the second clamping surface 16. The wedge 15 is then hammered or driven into the clamp portion 12 so that the metal sheet 20 for heat treatment is held in the clamping device 10 by compressive and frictional forces between the first clamping surface 14 on the clamp portion 12, and the second clamping surface 16 on the wedge 15.

A sufficient number of clamping devices 10 are used to secure the metal sheet 20 to the rack. For example, a ¼ inch thick by 80 inches wide by 250 inches long metal sheet 20 would be oriented in the vertical direction by securing clamping devices 10 on the 250-inch dimension on the ¼ inch thick upper edge 21 of the metal sheet 20. A typical sheet is hung with about 15 clamping devices mounted along the 250-inch edge. More or fewer clamps may be used depending on the weight of the sheet.

The known clamping device 10 for heat treating metal sheets 20, and the method of using the known clamping device 10, have several drawbacks. The process of driving or hammering the wedge 15 to clamp a large metal sheet 20 produces high noise levels. The metal sheet 20 resonates like a drumhead, and can potentially cause hearing loss to individuals in the vicinity, unless the individuals are wearing adequate hearing protection. The use of a hammer in a repetitive manner in an uncomfortable position over time can result in cumulative motion injury to the worker.

In addition to operator safety concerns associated with the known clamping device 10, the known clamping device 10 does not hold the metal sheet 20 well in all cases, and can cause damage to the metal sheet 20. The known clamping device 10 relies on compressive and frictional forces that are established between the first clamping surface 14, the metal sheet 20 and the second clamping surface 16, as the wedge 15 is hammered into the clamp portion 12. The compressive forces from the driven wedge 15 can cause the first 14 and second 16 clamping surfaces to embed in the metal sheet 20 during the heat treatment process.

When the clamped metal sheet 20 is removed from the furnace, it may be immersed in a water bath, which can have a temperature anywhere between near the ambient temperature or the boiling temperature. This process is called "water quenching." After the metal sheet 20 is water quenched, because of thermal contraction, it shrinks from the known clamping device 10 and some of the compressive force from the driven wedge 15 is lost. As a result, the prior art known clamping device 10 can slip off the metal sheet 20.

Thus, a need exists for a clamping device for vertically suspending metal sheet during heat treatment that does not present potential occupational safety hazards to worker, that does not damage the metal sheet, and is reliable in holding the metal sheet through all required operations of the manufacturing process.

Accordingly, it is an object of this invention to provide a clamping device to grasp and vertically suspend metal or metal alloy sheet of various thicknesses during a thermal processing step, or any processing step that is benefited by suspending the metal sheet in a vertical orientation.

Another object of this invention is to provide a method for grasping and vertically suspending metal or metal alloy sheet of various thicknesses during a thermal processing step, or any processing step that is benefited by suspending the metal sheet in a vertical orientation.

A further object of this invention is to provide a clamping device for vertically suspending metal or metal alloy sheet that remains clamped during rapid thermal changes that occur, for example, when hot metal or metal alloy sheets are quenched by immersion in a water bath.

Yet another object of this invention is to provide a method for clamping metal or metal alloy sheet that does not result in high noise levels and/or poor ergonomics that could cause physiological injury to operators and others near the clamping operation.

While a principal object of this invention is to provide a clamping device for use with metal or metal alloy sheet, it is recognized that the clamping device of this invention could be made to a size that could accommodate other forms of wrought or cast metal, such as but not limited to castings, forgings, plate, sheet, rod, bar, tube, wire, and structural shapes, such as but not limited to, I-beams, H-beams, channels, angles tees, and zees. Further, the clamping device could be used for grasping and suspending product forms such as for example wheels, bumpers, vehicular frame rails, boat hulls and aerospace wing struts, while these undergo various processing or finishing steps. These forms and other forms of metal are known to those skilled in the art. Therefore, the phrase metal or metal alloy sheet, as used herein, should be interpreted to include any metal or metal alloy workpiece that could be suspended by the clamp of this invention.

Furthermore, it should not be inferred that the clamping device of the current invention should be limited to clamping forms of metals and metal alloys, but it should be recognized that the clamp of this invention could be used for suspending a workpiece made of other materials, such as but not limited to plastics, composites, and laminates.

SUMMARY OF THE INVENTION

The objects of this invention are achieved by providing a clamping device for grasping and suspending a workpiece. A preferred embodiment of the clamping device includes: a clamp body, an eccentric wedge, and an eccentric cam. The clamp body further includes: at least one slotted arcuate spring end portion; an intermediate spring spreading portion contiguous with and extending from the slotted arcuate spring end portion, with the intermediate spring spreading portion having an eccentric bore; a jaw end portion contiguous with and extending from the intermediate spring spreading portion, with the jaw end portion comprising a jaw clamping surface and a bracket, with the bracket having a beveled sidewall wherein the jaw clamping surface and the bracket define a jaw opening; and a suspending means attached to the intermediate spring spreading portion. The eccentric wedge is slideably mounted in the bracket. The eccentric cam is rotatably disposed within the eccentric bore.

DETAILED DESCRIPTION OF A PREFERRED EMBODIMENT

Referring to FIGS. 4–14, a preferred embodiment of the clamping device of this invention is described. FIGS. 11–14 depict the assembled clamping device and a preferred method of operation.

Figure 3:
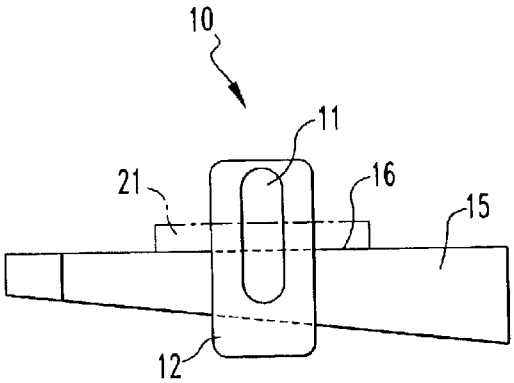
FIG.3 PRIOR ART
FIG. 3 is a top view of a known clamping device of the prior art shown grasping a metal sheet.
Figure 1:
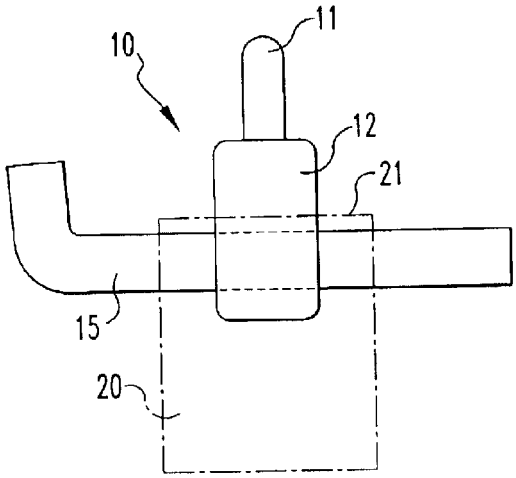
FIG.1 PRIOR ART
FIG. 1 is front view of a known clamping device of the prior art shown grasping a metal sheet.
Figure 2:
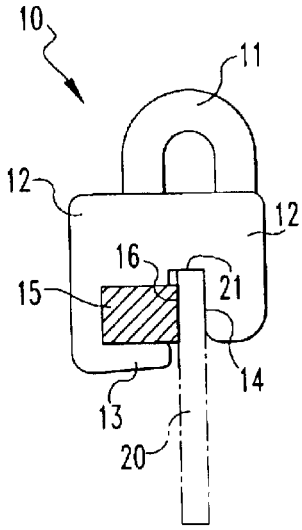
FIG.2 PRIOR ART
FIG. 2 is a side view of a known clamping device of the prior art shown grasping a metal sheet.
Figure 4:
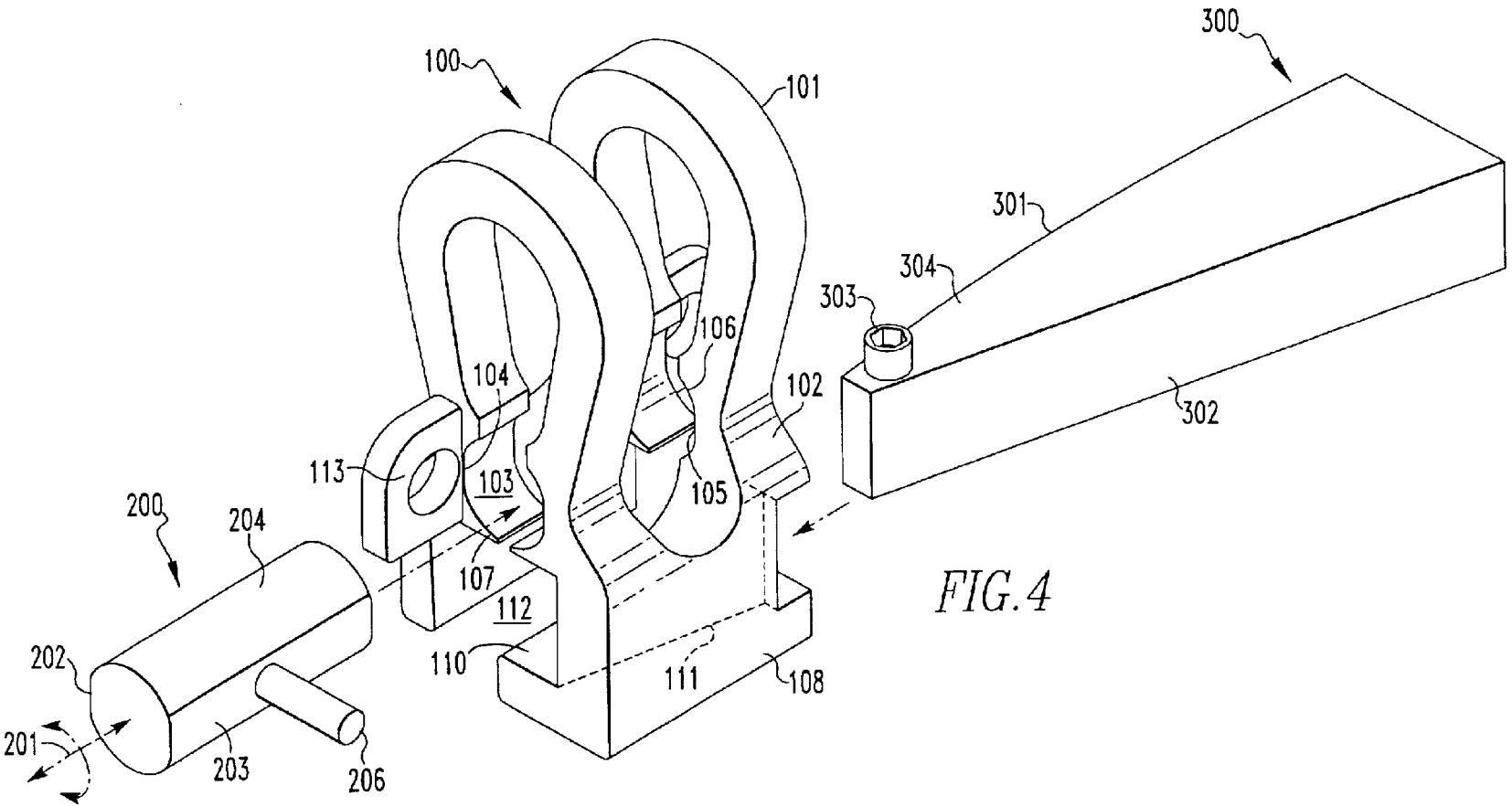
FIG. 4 is a perspective exploded view of a preferred embodiment of the clamping device of this invention.
Figure 5:
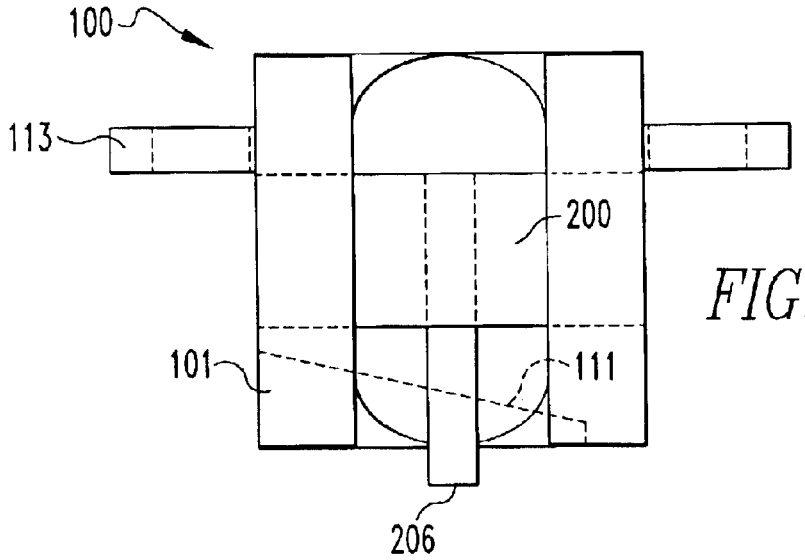
FIG. 5 is a top view of a preferred embodiment of the clamp body of the current invention.
Figure 6:
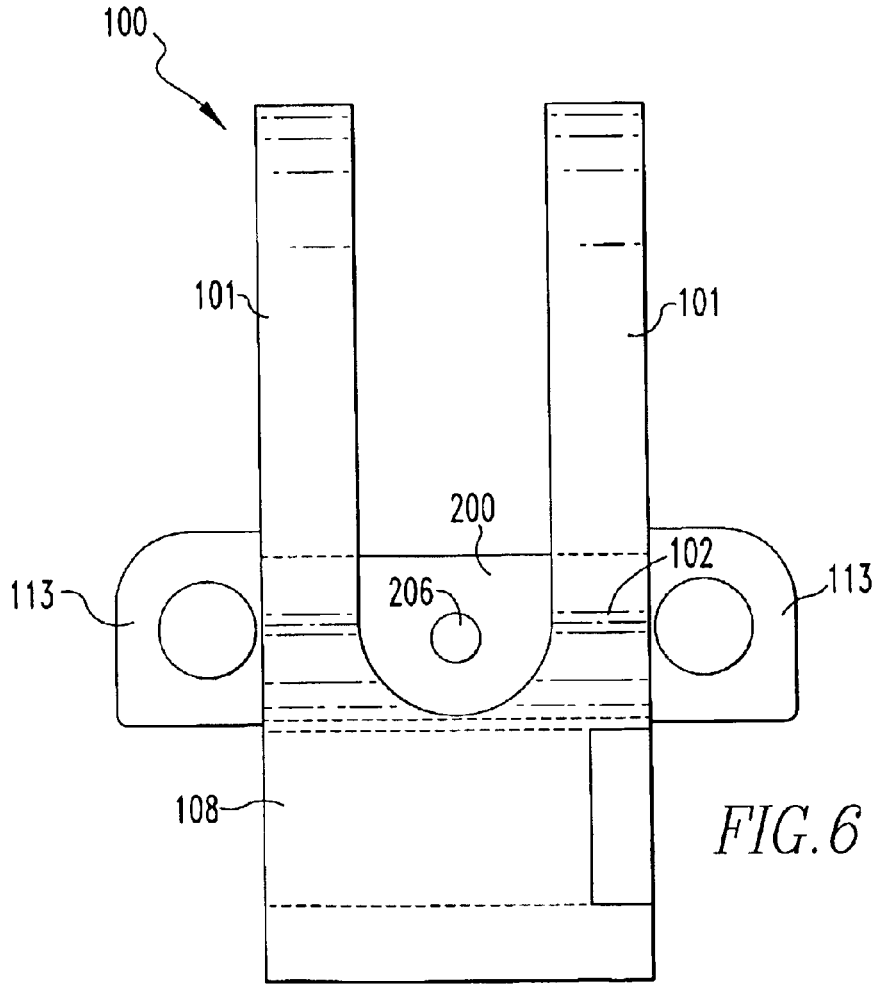
FIG. 6 is a front view of a preferred embodiment of the clamp body of the current invention.
Figure 7:
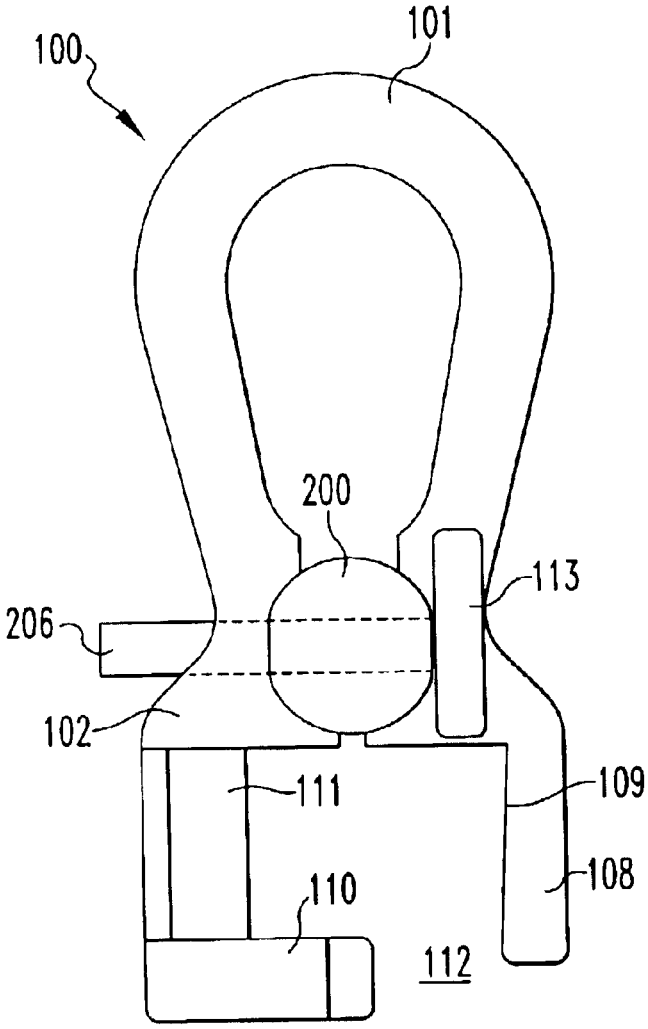
FIG. 7 is a side view of a preferred embodiment of the clamp body of the current invention.
Figure 8:
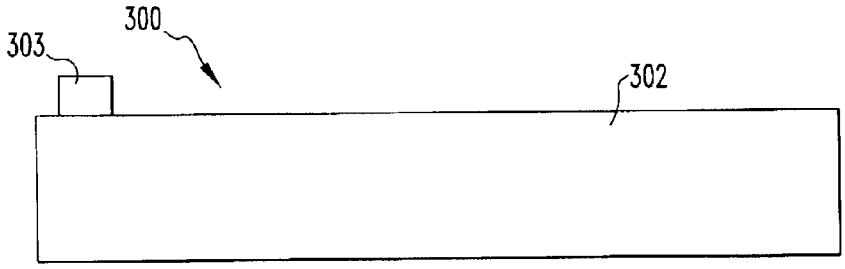
FIG. 8 is a front view of a preferred embodiment of the wedge of this invention.
Figure 9:
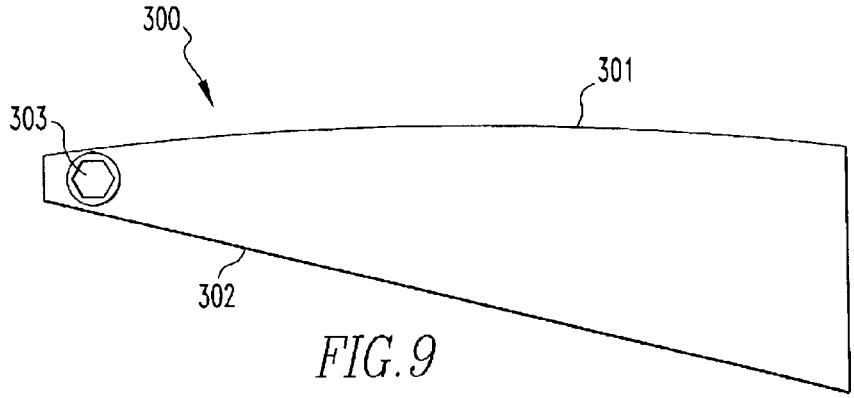
FIG. 9 is a top view of a preferred embodiment of the wedge of this invention.
Figure 10:
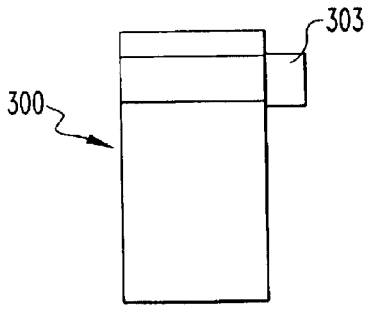
FIG. 10 is a side view of a preferred embodiment of the wedge of this invention.
Figure 11:
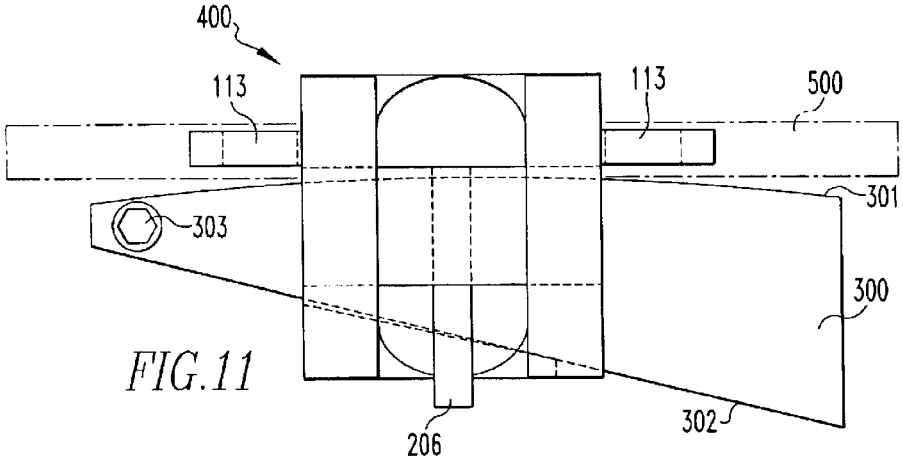
FIG. 11 is a top assembly view of a preferred embodiment of the clamping device of this invention with a grasped metal sheet shown in phantom.
Figure 12:
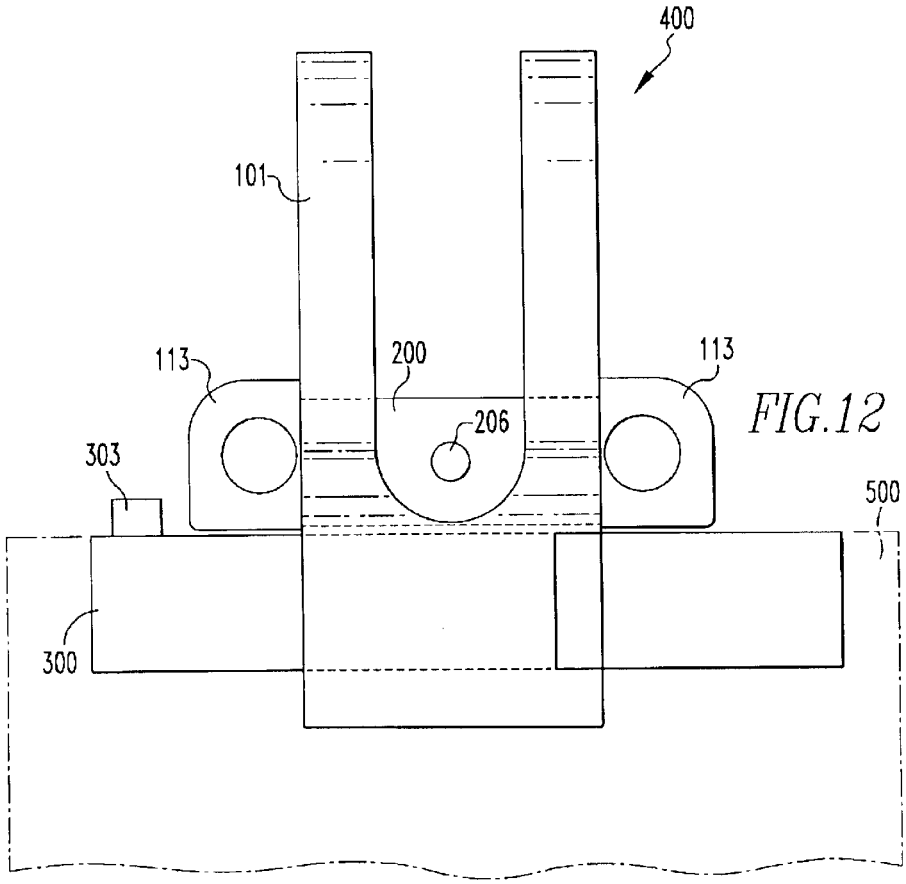
FIG. 12 is a front assembly view of a preferred embodiment of the clamping device of this invention with a grasped metal sheet shown in phantom.

Referring now particularly to FIGS. 4–7, a clamp body 100 of this invention is shown. The clamp body 100 comprises at least one slotted arcuate spring end portion 101. Contiguous with and extending from the slotted arcuate spring end portion 101 is an intermediate spring spreading portion 102. The intermediate spreading portion 102 contains a spring spreading means. In this preferred embodiment, an element of the spring spreading means is an eccentric bore 103. The bore has a planar sidewall 104 and a slotted planar sidewall 105 that is substantially parallel to and opposite of the planar sidewall 104. Contiguous with the planar sidewall 104 and the slotted planar sidewall 105 is a slotted concave wall 106. Opposite of the slotted concave wall 106 and contiguous with the planar sidewall 104 and the slotted planar sidewall 105 is a concave wall 107. An eccentric cam 200 is rotatably disposed in the eccentric bore 103. The eccentric cam 200 has a cam axis of rotation 201, which is schematically indicated in FIG. 4. The eccentric cam 200 of this preferred embodiment has a first planar cam surface 202 that is substantially parallel to the cam axis of rotation 201. A second planar cam surface 203 is substantially parallel to and opposite of the first planar cam surface 202. Contiguous with the first planar cam surface 202 and the second planar cam surface 203 is a first convex cam surface 204. A second convex cam surface 205 is opposite of the first convex cam surface 204 and contiguous with the first planar cam surface 202 and the second planar cam surface 203. A means for rotating the cam of this preferred embodiment comprises a lug 206 extending laterally form the eccentric cam 200, and which is accessible through the slotted planar sidewall 105, the slotted concave wall 106, and the slotted arcuate spring end portion 101. Contiguous with and extending from the intermediate spring spreading portion 102 is a jaw end portion 108. The jaw end portion 108 comprises a jaw clamping surface 109 and a bracket 110 having a beveled sidewall 111. The jaw clamping surface 109 and the bracket 110 define a jaw opening 112. In this preferred embodiment, perforated tabs 113 extend laterally from the intermediate spring spreading portion 102, and serve as a suspending means. However, it is understood by those reasonably skilled in the art that the suspending means could be located elsewhere on the clamp body 100, and that the suspending means could be of a form other than perforated tabs. A plurality of clamping devices, with metal clamped for heat treatment, could be hung on a rack, using the perforated tabs, and the entire rack of clamping devices with heat treatable metal could be positioned into a metal heat treating furnace, and subsequently heat treated.

While the preferred embodiment of the spring spreading means described in the previous paragraph relies on an eccentric cam and eccentric bore with planar, convex and concave surfaces, it is recognized by those skilled in the art that there are other embodiments employing a cam rotatably mounted in a bore that could be used as a spring spreading means. For example, an ovoid cam could be rotatably mounted within an ovoid or cylindrical bore. It is conceived that various combinations of shapes, including planar and various types of curved surfaces, could be used for eccentric bores and eccentric cams to serve as the spring spreading means of this invention.

Further, the rotating means described in the preferred embodiment herein, could be substituted with any other means of rotating the cam, such as but not limited to, rotating the cam by grasping it with a wrench or other hand tool.

The clamping device of this invention further comprises an eccentric wedge 300. Referring now particularly to FIGS. 4 and 8–10, the eccentric wedge 300 has a convex wedge clamping side 301 and a planar wedge side 302. The eccentric wedge 300 is slideably mounted in the bracket 110 of the clamp body 100. The convex wedge clamping side 301 is mounted opposite of the jaw clamping surface 109, so that the planar wedge side 302 is opposite of the beveled sidewall 111. In this preferred embodiment, the eccentric wedge 300 has a retention means to keep the wedge from dislodging from bracket 100 of the jaw end portion 108. This is a retaining projection 303 on a wedge face 304, where the wedge face 304 is contiguous with and substantially perpendicular to the convex wedge clamping side 301 and the planar wedge side 302.

The preferred embodiment for the eccentric wedge describes a convex wedge clamping side and a planar wedge clamping side opposite of the beveled sidewall of the bracket. This design enables a clamping device of this invention to grasp metal sheets of various thicknesses. It is within the present scope of the invention that other designs of wedges and bracket sidewalls consisting of curved and planar sides and surfaces could accomplish the same purpose of having one clamping device accommodate metal sheets of different thicknesses. A description of the method of using the clamping device follows later, which will further explain the operation and function of the eccentric wedge of the preferred embodiment of this invention.

In addition, the preferred embodiment of the eccentric wedge has a retaining projection on the wedge face to serve as a retention means for keeping the wedge slideably mounted in the bracket of the jaw end portion of the clamp body. The retaining projection should be of a length sufficient to stop the wedge from dislodging from the clamp body. The retaining projection may be, but is not limited to, a rivet, a screw, a bonded pin, a welded pin or a bolt.

Figure 14:
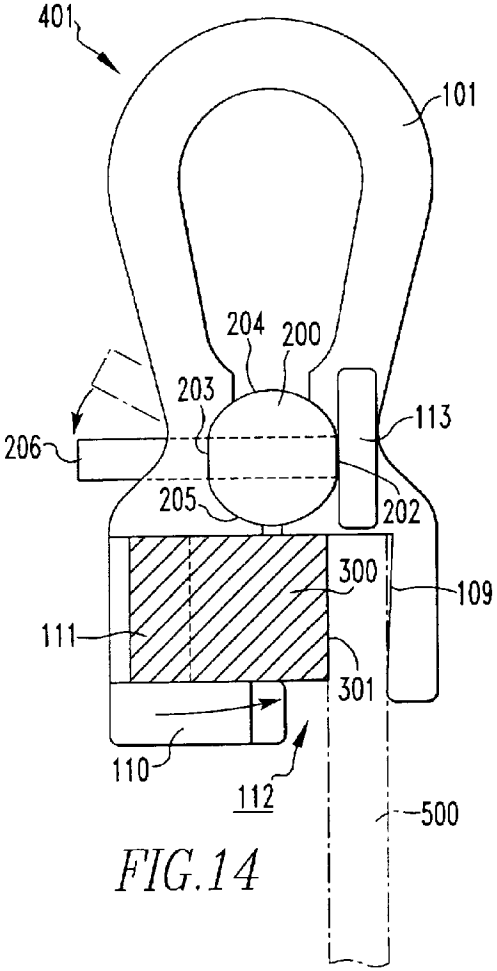
FIG. 14 is a side assembly view of a preferred embodiment of the clamping device of this invention with a grasped metal sheet shown in phantom, showing the deactivated position of the rotatable cam and the closed condition of the slotted arcuate spring end portion.
Figure 13:
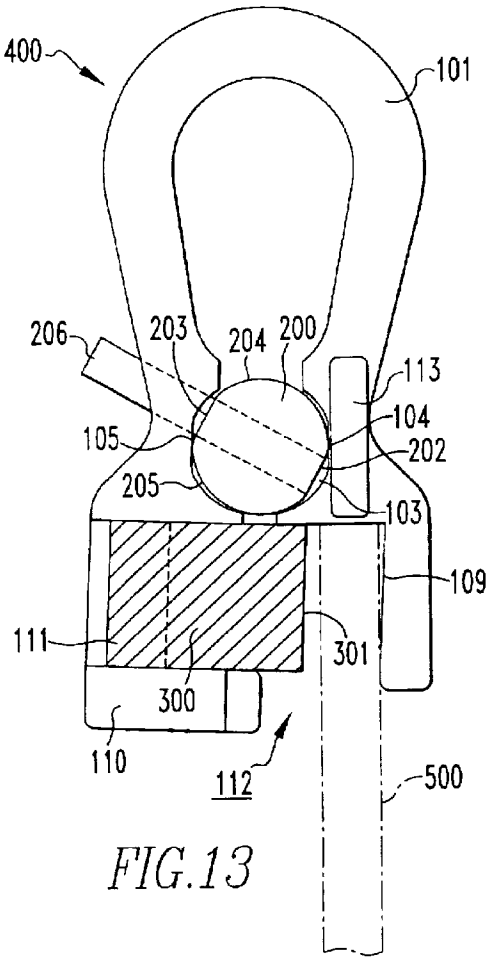
FIG. 13 is a side assembly view of a preferred embodiment of the clamping device of this invention with an inserted metal sheet shown in phantom, showing the actuated position of the rotatable cam and the spread condition of the slotted arcuate spring end portion.

The clamping device of this invention is designed to grasp and suspend a workpiece. Referring particularly now to FIGS. 4 and 11–14, which depict a preferred embodiment of this invention, a method of using this invention begins with providing the assembled clamping device of this invention 400 and a workpiece 500 (shown in phantom). To use the assembled clamping device 400 of this invention, the spring spreading means is actuated. In a preferred embodiment portrayed in FIGS. 4–14 herein, the spring spreading means is actuated by rotating the eccentric cam 200 in the eccentric bore 103 by moving the lug 206 around the cam axis of rotation 201, so that the second convex cam surface 205 comes into contact with the slotted planar sidewall 105 of the eccentric bore 103. This is the actuated position of the eccentric cam 200 and is depicted in FIG. 13. The effective diameter of the eccentric cam 200 is herein defined as the diameter of the eccentric cam 200 as measured at points of contact of the eccentric cam 200 with the middle point of the planar sidewall 104 and the middle point of the slotted planar sidewall 105. When the eccentric cam 200 is in the actuated position as described above, the effective diameter of the eccentric cam 200 is measured between the first convex cam surface 204 and the second convex cam surface 205. In the deactivated position, as shown in FIG. 14, the effective diameter of the eccentric cam 200 is measured between the first planar cam surface 202 and the second planar cam surface 203. The effective diameter of the eccentric cam 200 in the actuated position (FIG. 13), as measured between the first convex cam surface 204 and the second convex cam surface 205, is greater than the effective diameter in the deactivated position (FIG. 14), as measured between the first planar cam surface 202 and the second planar cam surface 203. The larger effective diameter of the eccentric cam 200, when in the actuated position, results in spreading or opening of the slotted arcuate spring end portion 101 and the jaw opening 112. In order to grasp a workpiece, a workpiece is inserted into the jaw opening 112 between the convex wedge clamping side 301 and the jaw clamping surface 109. The eccentric wedge 300 is slid until the eccentric wedge 300 contacts the workpiece 500 and the beveled sidewall 111 of the bracket 110. The shapes of the eccentric wedge 300 and the beveled sidewall 111, together with the action of sliding the eccentric wedge 300 until it contacts with the workpiece 500 and the beveled sidewall 111, enables the clamping device 400 of this invention to grasp workpieces of various thicknesses. After sliding the wedge, the spring spreading means is then deactivated by rotating the lug 206 on the eccentric cam 200 to a position where the second planar cam surface 203 is in substantial contact with the slotted planar sidewall 105, as shown in FIG. 14. The elasticity of the slotted arcuate spring end portion 101 provides compressive and frictional forces which cause the workpiece to be firmly grasped or held in the jaw end portion 108. A clamped workpiece 401 can be suspended, for example, on a rack by a suspending means, such as the perforated tabs 113 of the preferred embodiment described herein.

For heat treating metal, a clamped metal workpieces are typically suspended on racks and the racks are placed into a heat treating furnace or oven, or some other heating means, and are heated to a predetermined metal heat treatment temperature. Racks of clamped metal workpieces are held or "soaked" at the predetermined metal heat treatment temperature for a predetermined length of time. At the end of soaking the metal workpieces are typically either cooled by the air, or are quenched in a water or other liquid bath to either ambient temperature or to another desired processing temperature.

Plastic deformation is deformation of a material resulting from an applied load that becomes permanent when the load is removed from the material. In elastic deformation, when an applied load is removed, the material returns to its original shape. Therefore, the material of construction of the clamping device of this invention should primarily deform elastically, with unsubstantial plastic deformation, when the spring spreading device is actuated and subsequently subjected to metal heat treat temperatures. For the case of heat treatment of aluminum alloys at temperatures around 1000° F., a material of construction of choice for the clamping device is a nickel-chromium alloy, such as Inconel™. Inconel™ alloy 718 is a particularly preferred material of construction for the clamping device of this invention when the invention is used in heat treatment of aluminum alloys.

As set forth herein, the clamping device of the current invention overcomes deficiencies of known prior art clamping devices, particularly when used for metal and metal alloy heat treatment. The inventive clamping device is capable of vertically suspending metal or metal alloy sheet of various thicknesses. Because of the elastic nature of the inventive clamping device, the grasp on the metal sheet is maintained throughout processing steps, such as quenching, that involve sudden changes in temperature and differential thermal contraction of the clamping device and the metal sheet. Because the prior art clamp relied on frictional and compressive forces provided only by the hammered wedge in the clamp, there were no mechanisms for the known clamp to maintain a grasp on the metal sheet when the metal sheet thermally contracts during quenching. The elastic nature of the inventive clamping device overcomes this deficiency. Further, the inventive clamping device eliminates the high noise levels and poor ergonomics that were inherent with the known clamp.

What is believed to be the best mode of the invention has been described above. However, it will be apparent to those skilled in the art that numerous variations of the type described could be made to the present invention without departing from the spirit of the invention.

What is claimed is:

1. A clamping device for grasping and suspending a workpiece, said clamping device comprising:

(a) a clamp body, said clamp body comprising:
  (i) at least one slotted arcuate spring end portion;
  (ii) an intermediate spring spreading portion contiguous with and extending from said slotted arcuate spring end portion, said intermediate spring spreading portion having an eccentric bore;
  (iii) a jaw end portion contiguous with and extending from said intermediate spring spreading portion, said jaw end portion comprising a jaw clamping surface and a bracket, said bracket having a beveled sidewall wherein said jaw clamping surface and said bracket define a jaw opening; and
  (iv) a suspending means attached to said intermediate spring spreading portion;

(b) an eccentric wedge slideably disposed in said bracket; and (c) an eccentric cam rotatably disposed within said eccentric bore.

2. The clamping device of claim 1, wherein said eccentric bore comprises:

(a) a planar sidewall;

(b) a slotted planar side wall, said slotted planar sidewall is substantially parallel to and opposite of said planar sidewall;

(c) a slotted concave wall, said slotted concave wall is contiguous with said planar sidewall and said slotted planar sidewall; and (d) a concave wall, said concave wall is opposite of said slotted concave wall and is contiguous with said planar sidewall and said slotted planar sidewall.

3. The clamping device of claim 1, wherein said eccentric cam comprises:

(a) a first planar cam surface, said first planar cam surface parallel to said cam axis of rotation;

(b) a second planar cam surface, said second planar cam surface substantially parallel to and opposite of said first planar cam surface;

(c) a first convex cam surface, said first convex cam surface contiguous with said first planar cam surface and said second planar cam surface; and (d) a second convex cam surface, said second convex cam surface opposite of said first convex cam surface and contiguous with said first planar cam surface and said second planar cam surface.

4. The clamping device of claim 1, wherein said eccentric wedge comprises a triangular shaped body having a convex wedge clamping side, and a planar wedge side wherein said eccentric wedge is slideably disposed within said bracket, wherein said convex wedge clamping side is opposite of said jaw clamping surface, and wherein said planar wedge side is opposite of said beveled sidewall of said bracket.

5. The clamping device of claim 4, wherein said wedge further comprises:

(a) a wedge face contiguous with and substantially perpendicular to said convex wedge clamping side and said planar wedge side; and (b) a retaining projection from said wedge face for retaining said wedge in said bracket of said jaw end portion.

6. The clamping device of claim 1, wherein said eccentric cam further comprises a lug extending laterally from said eccentric cam which is accessible through said slotted planar sidewall and said slotted concave wall of said eccentric bore and through said slotted arcuate spring end portion of said clamp body.

7. The clamping device of claim 1, wherein said eccentric bore comprises a slotted ovoid bore and said eccentric cam comprises an ovoid can, said ovoid cam having a rotating means wherein said ovoid cam is rotatably disposed within said slotted ovoid bore.

8. The clamping device of claim 7, wherein said rotating means comprises a lug extending laterally from said ovoid cam which is accessible through said slotted ovoid bore and said slotted arcuate spring end portion of said clamp body.

9. The clamping device of claim 1, wherein said wedge further comprises a retention means to keep said wedge from dislodging from said jaw end portion.

10. The clamping device of claim 1, wherein said clamping device is fabricated from a metal alloy that maintains elasticity at metal heat treatment temperatures.

11. The clamping device of claim 1, wherein said clamping device is fabricated from Inconel™ alloy.

12. The clamping device of claim 1, wherein said clamping device is fabricated from Inconel™ alloy 718.

* * * * *